United States Patent [19]

Sutton, II

[11] 4,288,196

[45] Sep. 8, 1981

[54] COMPUTER CONTROLLED BACKHOE

[76] Inventor: James O. Sutton, II, 14515 East Rd., Montrose, Mich. 48457

[21] Appl. No.: 47,735

[22] Filed: Jun. 14, 1979

[51] Int. Cl.[3] ..... E02F 9/26; E02F 3/87

[52] U.S. Cl. ..... 414/699; 37/103; 37/DIG. 20; 212/189; 280/6.1; 280/764; 172/4.5

[58] Field of Search ..... 414/694, 695, 699, 685, 414/687; 37/103, DIG. 1, DIG. 19, DIG. 20; 212/145, 189; 180/41; 280/6.1, 6 R, 6 H, 764; 318/489, 584–587; 340/27 AT; 73/178 R; 172/2, 4, 4.5

[56] References Cited

U.S. PATENT DOCUMENTS

| | | | |
|---|---|---|---|
| 3,487,958 | 1/1970 | Shook et al. | 414/699 |
| 3,643,828 | 2/1972 | Elliot | 414/699 |
| 3,831,683 | 8/1974 | Ikeda et al. | 172/4.5 |
| 3,997,071 | 12/1976 | Teach | 37/DIG. 19 X |
| 4,015,729 | 4/1977 | Parquet et al. | 414/699 X |
| 4,037,742 | 7/1977 | Gustafsson | 414/699 X |
| 4,044,838 | 8/1977 | Wooldridge | 172/2 |
| 4,149,251 | 4/1979 | Noordermeer et al. | 37/DIG. 1 X |
| 4,156,317 | 5/1979 | Schmidt | 37/DIG. 1 X |
| 4,162,708 | 7/1979 | Johnson | 172/4.5 |

*Primary Examiner*—Leslie J. Paperner
*Assistant Examiner*—Terrance L. Siemens
*Attorney, Agent, or Firm*—Head & Johnson

[57] ABSTRACT

A backhoe includes a computer capable of automatically controlling the depth or lowermost point of the backhoe bucket. The computer is programmable to provide level operation of the backhoe, will have preset common depths and programmable depths, and further include an automatic empty and return cycle, and to maintain a given level or slope of a desired ditch. Special resistors are positioned at all of the pivot points of the backhoe to act as sensors for relaying information to the computer. The output of the computer controls hydraulic valves which, in turn, operate the outriggers, boom, crowd and bucket of the backhoe assembly.

4 Claims, 7 Drawing Figures

COMPUTER CONTROLLED BACKHOE

BACKGROUND OF THE INVENTION

This invention is involved in the field of material handling vehicles, particularly backhoes.

A backhoe is commonly used in the art to dig ditches, foundations, or basements and, as such, requires in many instances that the bottom level of the ditch, foundation or basement be maintained at a given level or desired elevation or slope. The accomplishment of this depth in the normal operation of a backhoe is by sight, i.e. the operator judging from the relative distance from his position to the location of the bucket as it is placed in the ditch. Although the problem is difficult even on level terrain, the maintenance of a constant depth becomes more complex on irregular terrain. Although highly experienced operators may be able to attain depth accuracies that are sufficient, the problem is compounded by inexperienced operators, who are unable to maintain a constant depth required for particular situations. In addition, where it is desired to have a particular ditch drop or rise in elevation, the judgement of this by the operator is very difficult despite the amount of experience.

SUMMARY OF THE INVENTION

The present invention relates to an automatic computer operated control system for a mechanism on a material handling vehicle that has a backhoe assembly The invention is particularly directed to a programmed and pre-programmable computer used in combination with the vehicle so as to sense the relative location of the backhoe assembly mechanism including boom, crowd, and a bucket relative to a desired digging mode. Sensor devices, such as variable resistors, are at the various pivot points of the backhoe assembly and generate a signal to a computer, which, in turn, is capable of supplying binary movement data to hydraulic control valves operating the various parts of the backhoe assembly, including the outrigger leveling device or devices.

The present invention is further directed to a backhoe assembly as a part of a vehicle, which may be manually operated but controlled by a programmed computer so that the operator cannot go beyond certain desired levels or distances.

In particular, the invention is directed to a vehicle having a frame with an imaginary "x" or roll axis and a "y" or pitch axis. At least two outriggers pivotal to the frame are used to level the frame relative to the "x" axis with appropriate hydraulic actuators to move the outriggers. A backhoe assembly is attached to the frame pivotally and comprises a boom pivotal at one end to the frame with appropriate hydraulic means to pivot the boom in its vertical plane, along with appropriate hydraulic means to pivot the boom in a horizontal plane. A crowd is pivotal of one end of the other end of the boom and includes appropriate hydraulic means to pivot the crowd in the vertical plane. A bucket is pivotal to the other end of the crowd and includes appropriate bucket hydraulic means to pivot the bucket in the vertical plane. Appropriate manual control valves are located adjacent the operator's position to control all of the aforesaid hydraulic actuators and means. The improvement in the invention is directed towards a multiple-bit computer with interphase and pre-programmed ROM to provide information to a central processor in the computer for the purpose of supplying binary movement data relative to a desired standard to the backhoe assembly or parts thereof. Suitable control voltage is supplied to the computer. The system further includes a dual axis gyro fixed to the frame means in the computer, which continuously senses the positions of the "x"-"y" axes of the frame, which information being supplied to the computer compensates for changes in the frame relative to the work. Variable resistors are located at the pivot axes of the outriggers, the boom, the crowd, and the bucket to sense the pivotal position of each outrigger, the boom, the crowd, and the bucket relative to the "x"-"y" axial position of the frame. The manual control valves also include means to electrically operate each of them and a switch is provided in the control to select manual or computer operation of the valves. A switch is provided to activate and interconnect the gyro with the interphase of the computer and to generate a signal to operate the outrigger hydraulic actuators to level the frame. A visual indicator is provided for the operator, which indicates an unsafe position of the frame for operation. Another switch is provided to actuate the computer to allow it to receive desired programming of bucket depth, elevation, whether level or sloping, which further includes means to input the desired depth information to the memory (RAM) of the computer.

In addition to the above the invention further includes means to generate a read signal to the computer so as to permit it to receive input of the location of the "y" axis of the frame relative to the desired work centerline. A visual means is provided to indicate an inoperative position of the frame to the work centerline. In addition thereto, a switch means may be used to automatically raise the backhoe assembly and pivot same to one side of the work for dumping the bucket and, likewise, a switch is provided to return the backhoe assembly to the work centerline.

DETAILED DESCRIPTION OF THE DRAWINGS

Before explaining the present invention in detail, it is to be understood that the invention is not limited in its application to the details of construction and arrangement of the parts illustrated in the accompanying drawings, since the invention is capable of other embodiments and being practiced or carried out in various other ways.

Also, it is to be understood that the phraseology or terminology employed herein is for the purpose of description and not of limitation.

Figure 1:
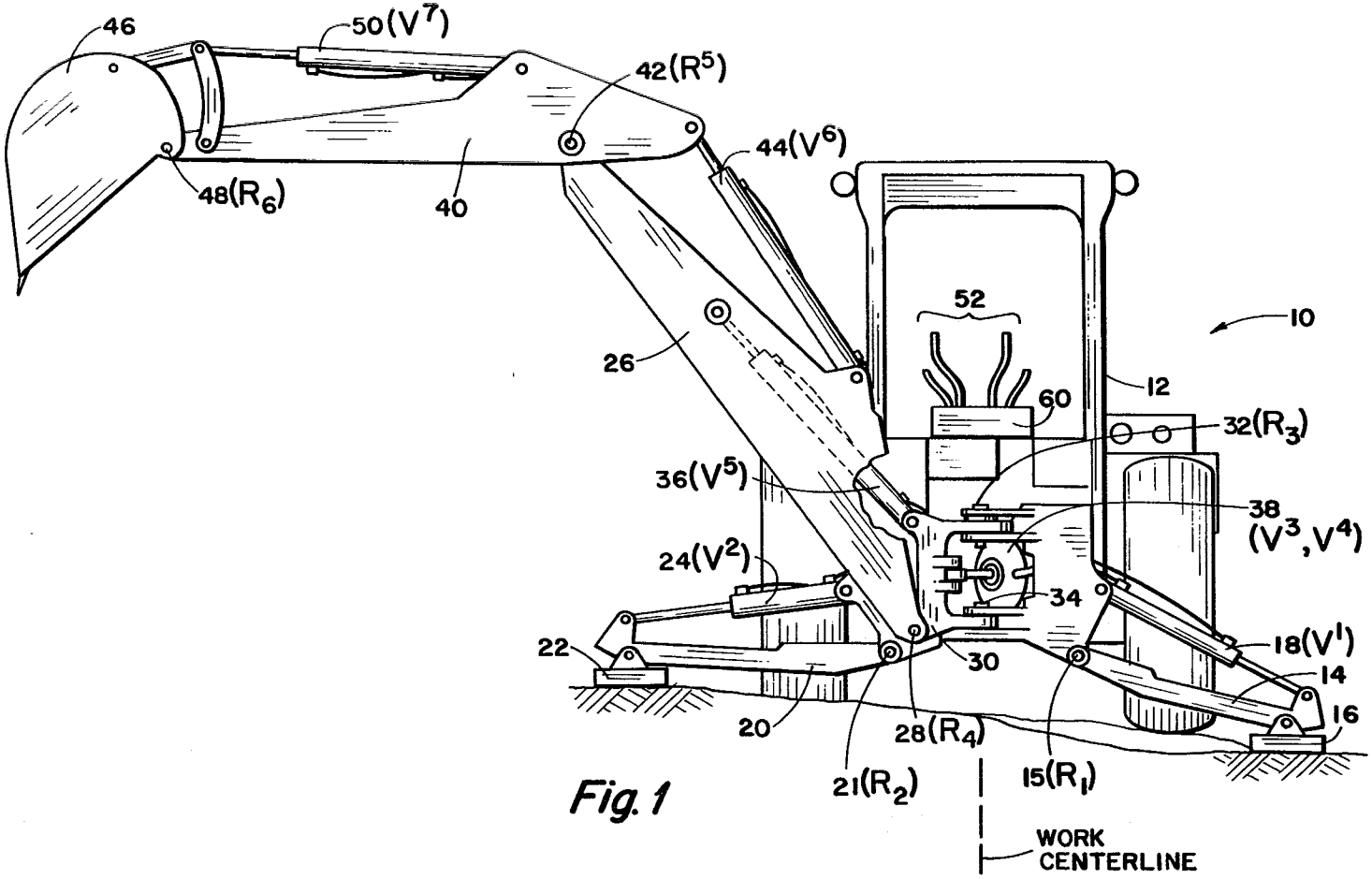
FIG. 1 is a rear view looking from the front of a backhoe with the backhoe assembly to one side.

Referring to FIG. 1 a vehicle generally designated by the numeral 10 includes a framework 12, which frame, for the purposes of this invention, will have an imaginary "x" or roll axis and a "y" or pitch axis and is positionable relative to the desired work center line shown by the dashed line. The vehicle frame includes a first outrigger 14, pivotal to the frame at 15 at one end while the other end includes some form of a pad 16 for contact with the ground. The outrigger is operable by means of a hydraulic cylinder 18. Likewise, on the other side of the vehicle is a second outrigger 20 having a ground pad 22 at the outer end with the arm pivotal at the inner end at 21. A hydraulic cylinder 24 operates this outrigger. Although only two outriggers are shown in this embodiment it is understood that concepts of the invention are applicable to more than two outriggers and, in some instances, to vehicles where there are no outriggers, i.e. steam shovels.

The vehicle includes a backhoe assembly which comprises a boom 26 pivotal in the vertical plane at one end 28 to a yoke 30, which is pivotal about an upper pin 32 and lower pin 34 to move the assembly in a horizontal plane. A hydraulic cylinder 36 moves the boom in the vertical plane while hydraulic power means 38 moves the backhoe assembly in the horizontal plane, i.e. to the operator's right, where another hydraulic cylinder, not in view, moves it to the left.

A crowd 40 is pivotal to the outer end of the boom 26 at pivot 42 being movable in the vertical plane by the hydraulic cylinder 44. At the outer end of the crowd is a bucket 46, likewise in the vertical plane at 48 by hydraulic cylinder 50. Adjacent the operator's position on the vehicle frame are a plurality of controls 52, positioned in a well-known manner capable of manually operating the various hydraulic cylinders to achieve the desired movement. Adjacent the operator's position is the computer control console 60 of this invention.

Figure 2:
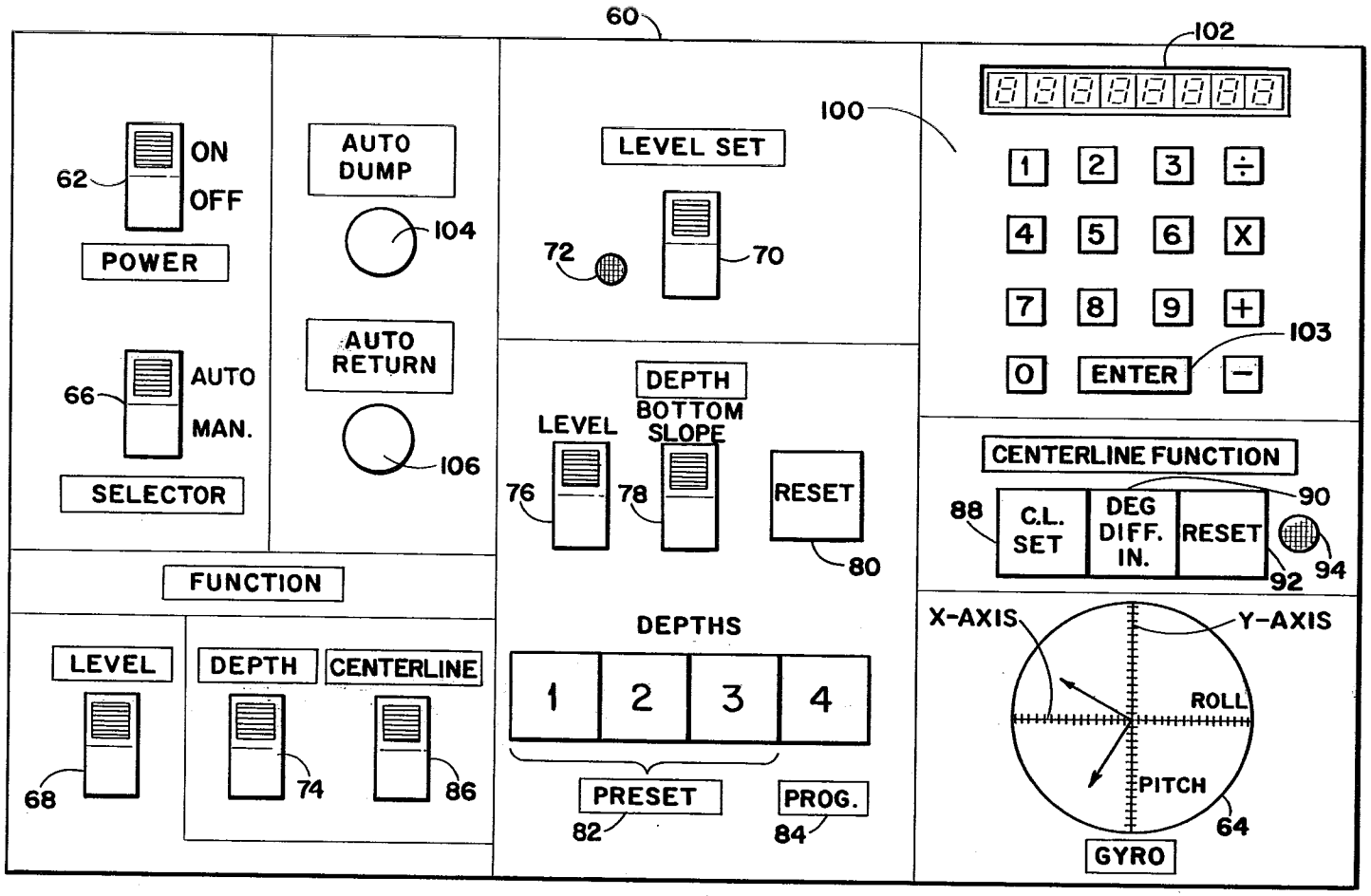
FIG. 2 is a plan view of the operator's control console.

In FIG. 1 various items have been designated with a "V" and "R". These are identified herein for purposes of describing the operation relative to the use with computer 60 and are identified:

$V^1$ outrigger 14 hydraulic cylinder
$V^2$ outrigger 20 hydraulic cylinder
$V^3$ backhoe assembly horizontal movement left direction
$V^4$ backhoe assembly horizontal movement right direction
$V^5$ boom hydraulic cylinder
$V^6$ crowd hydraulic cylinder
$V^7$ bucket hydraulic cylinder Variable resistors are used to provide output information as to the relative motion and location of the various backhoe assembly parts. These are identified as:

$R_1$ outrigger 14 relative to frame
$R_2$ outrigger 20 relative to frame
$R_3$ backhoe assembly relative to frame-horizontally
$R_4$ boom, relative to yoke
$R_5$ crowd, relative to boom
$R_6$ bucket, relative to crowd Referring now to FIG. 2, the computer 60 control panel is depicted. This panel will be situated relative to the operator for his use and will include a power switch 62 to turn the computer on or off. 12 volts are supplied being transformed to the various voltages required by the computer.

A gyro formed as a part of the computer and vehicle frame system 64 has a visual output indicator 64 formed as a part of the control panel to thereby give the operator a visual indication of the "x"-"y" axis position of the vehicle.

A selector switch 66 gives the operator the choice of automatic or manual operation. A series of function switches includes a level switch 68 which is operable in conjunction with level set switch 70 and a warning light 72. The purpose of the level function switches are to set the outriggers to a substantially level position while the warning light indicates an unsafe or inoperable position of the vehicle, or at least indicating that correction is desired. A depth function switch 74 operates to control the various backhoe assembly members to a desired depth which has been programmed into the computer, either utilizing one of a plurality of preset depths 82 or a pre-programmed depth 84. The bottom of the ditch can be set to either "level" i.e. constant depth relative to a given elevation via switch 76 or a sloping bottom utilizing switch 78. If a change of slope or level depth is desired during the work process reset switch 80 is actuated. That generates a READ signal within the computer to receive a changed slope or level depth input.

When center line switch 86 is activated a READ signal is generated in the computer to receive information pertaining to the center line of the work. By activating "set" switch 88 changes in the vehicle relative to that center line set are computed, which permit compensation of the backhoe assembly in the event of change of location of the vehicle. Activation of the "Degree Difference In" switch 90 occurs when the vehicle starts off-center. The transit shot will give the operator the number of degrees off center line which is entered at the keyboard into the computer. The reset switch 92 is used in the event there is changed data as to the work center line. Warning light 44 indicates an inoperable work angle.

The computer control panel also includes a keyboard 100 capable of providing and supplying desired arithmetic functions or data to the computer, which is viewed at LED display 102. An "enter" button 103, when pressed, places the information into the computer program.

The computer used herein is a multiple-bit type with standard interphase, e.g. TTY or BAUDOT and preprogrammed Read Only Memory (ROM), which is capable of providing information to a central processor in the computer for the purposes of vectorization, i.e. location of the backhoe assembly and the parts thereof. An example of an operable computer for use is that sold under the trademark "ALTAIR" No. 680A or B.

A typical gyro for use in this invention is that manufactured by Edo-Aire Model No. 52021. The gyro should be a dual-axis gyro that is fixed to the frame means in or as a part of the computer so as to continually sense the position of the "x" and "y" axes of the frame and, thus provide a comparative signal to a given standard such that the computer will sense, display same as at 64, and use the signal to control the operation of the backhoe assembly.

Figure 3:
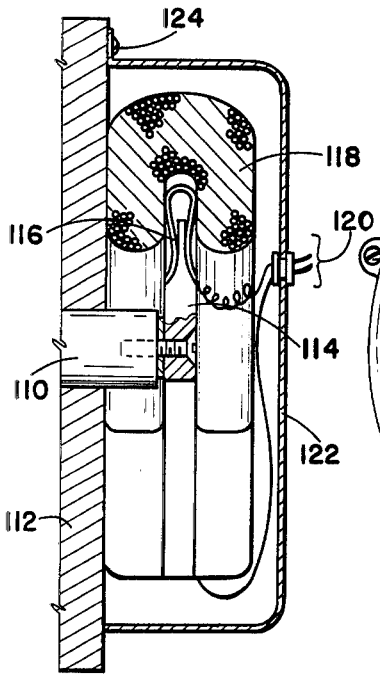
FIG. 3 is a cross-sectional view of a typical variable resistor used at the various pivotal connections of the backhoe.
Figure 4:
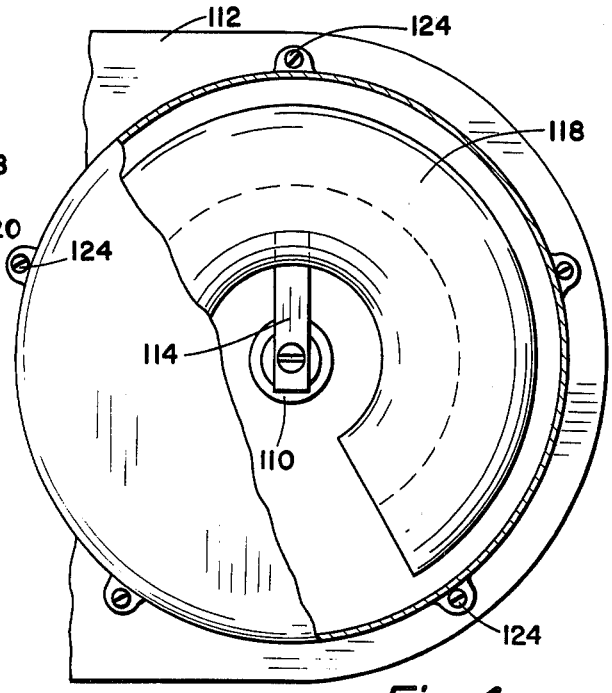
FIG. 4 is a partial section front view of the apparatus of FIG. 3.

The variable resistors "R" as designated herein may be of the type as shown in FIGS. 3 and 4. A pivot axis or shaft 110, which is pivotal, relatively speaking, to a portion 112 includes a fixed contact 116 relatively movable and in contact with wound resistor 118. It is believed that a 5,000 ohm resistor is sufficient for providing the information for use in the computer to determine the relative location of the relatively movable parts as previously described. Suitable output leads 120 are connected with the computer. The resistor has a protective cover 122, which may be bolted to one of the elements, e.g. 112.

Figure 5:
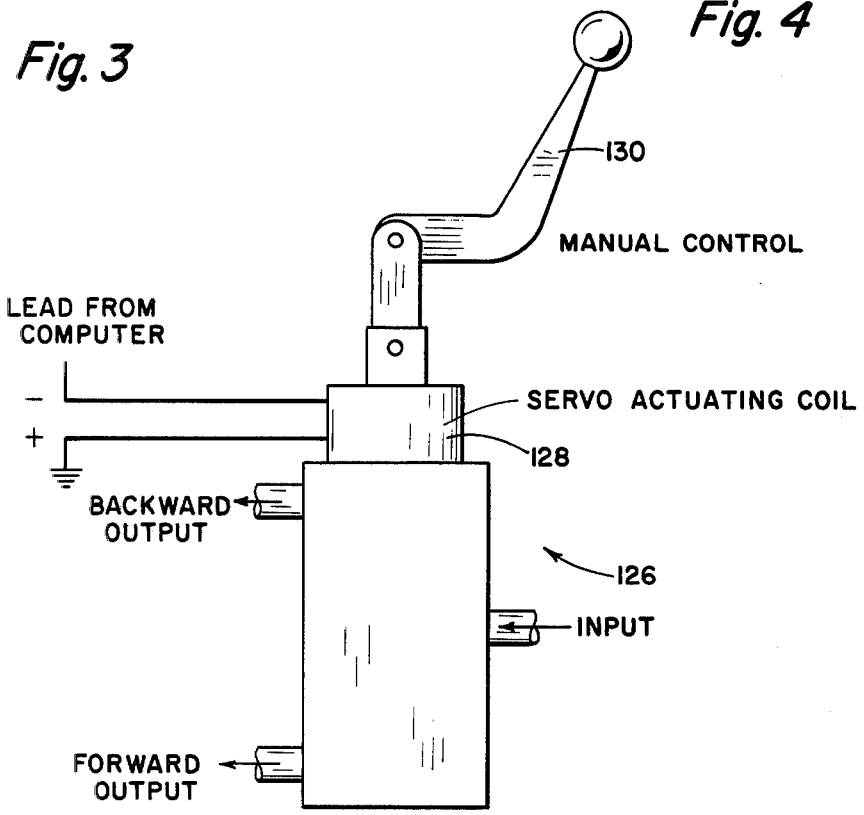
FIG. 5 is a typical hydraulic servo-control valve used in this invention.

Referring now to FIG. 5, the control valve 126 is depicted and is of a type typically found in backhoe type vehicles, which in this instance is modified to include a servo-actuating coil 128 electrically connected to automatically operate the valve, when being used with the computer herein.

Figure 6:
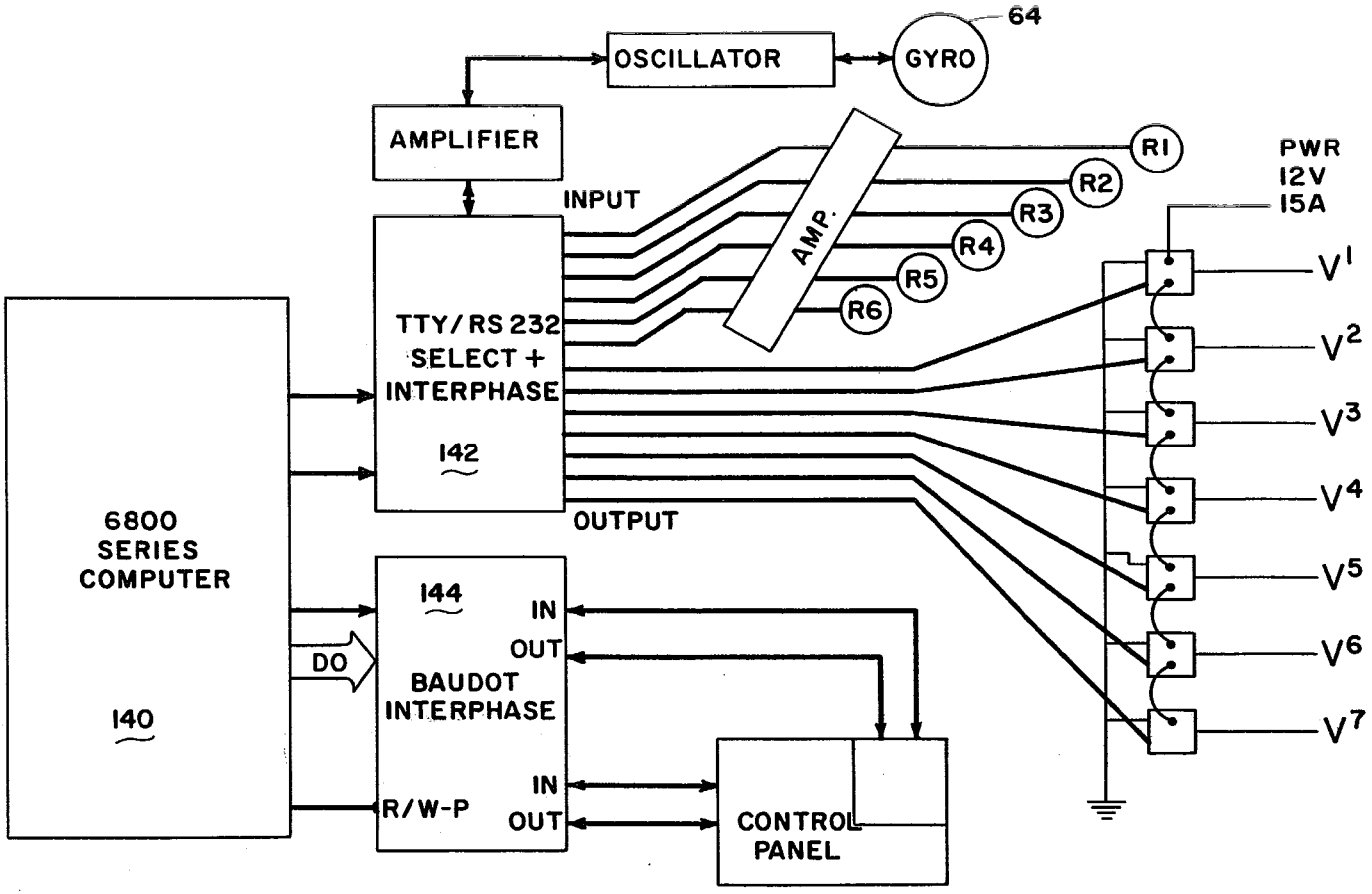
FIG. 6 is a schematic view of the computer and electrical control network.
Figure 7:
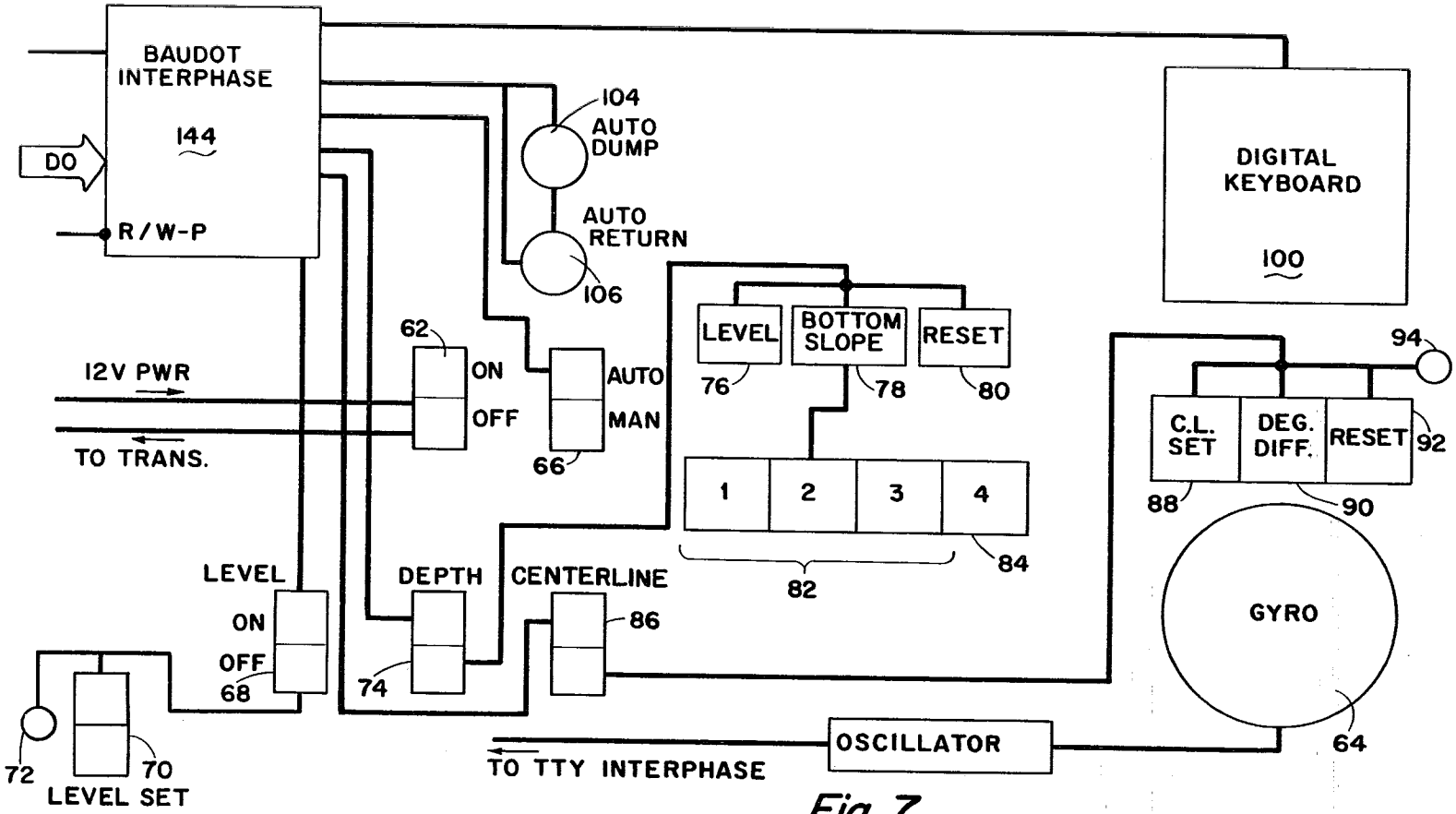
FIG. 7 is a schematic view of the console electrical circuitry.

FIGS. 6 and 7 are schematic diagrams describing the various portions of the computer relative to the hydraulic control valves "V", resistors "R", and gyro 64, FIG. 7 being the schematic of the control panel.

OPERATION

As a typical example of the use of this device a backhoe operator is to dig a level foundation base at a six-foot depth. The foundation line must be straight and accurate and the ground is on a slight upgrade. To achieve this automatically the operator will activate power switch 62, which provides 12-volt power to the computer and via suitable transformers the required control voltages necessary in the computer. Thereafter, the switch 66 is turned to the auto mode, at which this time the computer will execute restart procedures and prepare to receive pre-programmed or programmable information. All of the RAM memories are clear and the gyroscope is initiated into operation.

The operator will then activate the level switch 68 to the "on" position and activate the level set switch 70. The tractor or vehicle will begin to level itself utilizing the outriggers 14 and 20 by way of hydraulic members 18 and 24. This is accomplished via the computer by the central processor unit (CPU) generating a read signal to a TTY, e.g. Texas Instruments RS-232, interphase to the gyro. Compensation will be made by the CPU through the hydraulic valve structure to the outrigger members until the gyro signal to the comparator in the computer registers zero. If a level situation is not possible or an irregular or too steep of an angle for safety purposes occurs, then warning light 72 will activate. The operator may then choose to manually override this function by pressing manual switch 66 and use visual gyro confirmation at indicator 64 to do the levelling operation. The operator will then manually place the bucket a few inches above the ground with the automatic mode off or on manual.

The next step is to take a transit or elevational reading to the end of the bucket and determine the needed depth relative to the foundation level. This depth is then entered by turning on the level depth function switch 76, which activates the memory to a "read" mode (RAM or Random Access Memory). To set the depth the operator may use a standard pre-programmed depth therein by pressing appopriate switch 82. Any other depth is programmed by actuation switch 84, entering, via the keyboard 100, the desired length. The transit is used to determine the difference between the bucket center point (usually some type of indicia marking on the bucket) and the tractor center line in a linear alignment angle.

The operator will then turn on center line function 88, which generates a standard computer read mode for this function, sensing the gyro reading and deposit such information in the RAM. The degree difference switch 90 will permit the operator to enter in the keyboard the number of degrees of difference of the frame to the right (plus) or to the left (minus) of the desired work center line.

The operator then begins normal digging procedures utilizing the hydraulic control mechanisms 52. When he has filled the bucket he will hit the auto dump switch 104 and, because of prior programmed information in the computer, the various valves will automatically actuate to raise the bucket approximately three feet above the work. This is changeable. When this is accomplished the computer sends appropriate signals to electrically operate the valve structures until the comparator registers zero. The interrupt signal stops the operation and the operator may then manually dump. It is to be understood that further movement of the bucket, as, for example, to a height that will automatically dump the bucket into an awaiting vehicle is possible, if desired and needed.

To return the bucket to its proper alignment for the next digging operation the operator would push the auto return switch 106 to realign the bucket to the work. This is accomplished by a standard "go to" signal being generated in the computer and going to the appropriate portion of the RAM memory as to the original bucket alignment vector. This is fed into the comparator by the CPU. Adjustments of the backhoe assembly are made until the comparator registers zero. When the desired depth is reached the computer will then control and maintain the bottom depth, i.e. prevent the bucket from going beyond the preset depth. This is accomplished by the variable resistor (R) feedback reaching the computer's calcuated electrical output, at which time the computer overrides the manual control of the bucket drop. The CPU brings the depth figure from the RAM into the comparator and, as the bucket is drawn in, the computer makes valve adjustments to insure that the comparator reading remains zero. Operation is repeated until the work is completed. When the tractor is let down on its wheels by the operation of the outriggers, and moved relative to the work center line and the level procedures repeated. Once the initial level and depth information is placed into the computer changes in the elevation and/or axial location of the vehicle are automatically compensated for. During each instruction and operation the computer utilizes simple "RAM" and memory. R/W statements as well as some variable resistor input through the TTY select interphase which goes directly to a comparator register and then to the RAM memory. The gyro also use this interphase system after an oscillator and amplifier. All input is on a clocked time sharing basis with the longest expected wait being about 12 milliseconds. It is to be understood that the control panel may use several different interphase setups, such as BAUDOT, TTY, etc., also on a time sharing select basis. Further, some backhoe assemblies include additional boom or crowd members than those shown here. A man skilled in the art can apply the principles herein to such additional members. Although not preferred, a computer with a tape or disc memory is applicable.

What is claimed is:

1. In a vehicle having a frame having an imaginary "x" or roll axis and a "y" or pitch axis, at least two outriggers pivotal to the frame to level the frame relative to the "x" axis, a a first and a respective second hydraulic actuator to move each respective outrigger, a backhoe assembly comprising a boom pivotal at one end to the frame, hydraulic means to pivot the boom in a vertical plane, and boom hydraulic means to pivot the boom in a horizontal plane, a crowd pivotal at one end to the other end of the boom, crowd hydraulic means to pivot the crowd in the vertical plane, a bucket pivotal at the other end of the crowd, bucket hydraulic means to pivot the bucket in the vertical plane, and a manual control valve for each of the hydraulic actuators and hydraulic means, the improvement comprising:

a multiple bit computer with interphase and pre-programmed ROM to provide information to a central processor in the computer for the purpose of vectorization of the backhoe assembly or parts thereof, and means to controllably provide required voltages to the computer, a dual axis gyro fixed to the frame means in the computer to continuously sense the position of the "x"-"y" axes, variable resistors located at the pivot axes of the outriggers, the boom, the crowd, and the bucket to sense the pivotal position of each outrigger, the boom, the crowd and the bucket relative to the "x"-"y" axial position of the frame, means to electrically operate each of the control valves;

switch means to select manual or computer operation of the valve, switch means to activate and interconnect the gyro with the interphase of the computer and to generate a signal to operate the outrigger hydraulic actuator to level the frame, visual means to indicate an unsafe position of the frame, switch means to activate the computer to allow it to receive desired programming of the bucket depth relative to a given elevation, means to input the desired bucket depth information to the memory (RAM) of the computer.

2. The apparatus of claim 1, the further improvement comprising, switch means to generate a read signal to the computer so as to permit it to receive input of the location of the "y"-axis of the frame relative to the desired work center line, visual means to indicate an inoperative position of the frame to the work center line.

3. The apparatus of claim 1, the further improvement including, switch means to automatically raise the backhoe assembly and pivot same to one side of the work for dumping of the bucket, and switch means to return the backhoe assembly to the work center line.

4. In a vehicle having a frame and back-hoe assembly attached thereto, including a bucket for digging which assembly is hydraulically controlled for movement in a horizontal and vertical direction, the improvement comprising:

a dual axis gyro fixed to the vehicle to sense the position of the back-hoe assembly relative to a given imaginary x (roll axis) and y (pitch axis);

a multiple bit computer with interface and pre-programmed ROM to provide information to a central processor in the computer for the purpose of vectorization or positioning of the back-hoe assembly or parts thereof; and means to activate the computer to allow it to receive desired programming of the bucket depth relative to a given elevation, and means to input the desired bucket depth information to the memory (RAM) of the computer.

* * * * *